US011672311B1

(12) United States Patent
DesRuisseaux

(10) Patent No.: US 11,672,311 B1
(45) Date of Patent: Jun. 13, 2023

(54) ADHESIVE FABRIC FASTENER

(71) Applicant: Ann DesRuisseaux, Palm Beach, FL (US)

(72) Inventor: Ann DesRuisseaux, Palm Beach, FL (US)

( * ) Notice: Subject to any disclaimer, the term of this patent is extended or adjusted under 35 U.S.C. 154(b) by 0 days.

(21) Appl. No.: 17/574,280

(22) Filed: Jan. 12, 2022

Related U.S. Application Data

(63) Continuation of application No. 15/179,772, filed on Jun. 10, 2016, now abandoned.

(60) Provisional application No. 62/173,780, filed on Jun. 10, 2015.

(51) Int. Cl.

| | |
|---|---|
| ***A44B 17/00*** | (2006.01) |
| ***A41F 1/02*** | (2006.01) |
| ***A41D 27/08*** | (2006.01) |
| ***A41F 1/00*** | (2006.01) |
| ***A47G 11/00*** | (2006.01) |
| ***A44C 3/00*** | (2006.01) |
| ***A41B 1/10*** | (2006.01) |
| ***A44B 99/00*** | (2010.01) |

(52) U.S. Cl.
CPC ..... *A44B 17/0064* (2013.01); *A41B 1/10* (2013.01); *A41D 27/08* (2013.01); *A41F 1/004* (2013.01); *A41F 1/02* (2013.01); *A44B 17/0041* (2013.01); *A44B 17/0058* (2013.01); *A44B 99/00* (2013.01); *A47G 11/003* (2013.01); *A41B 2300/324* (2013.01); *Y10T 24/33* (2015.01)

(58) Field of Classification Search
CPC ..... A44B 17/0064; A44B 17/0041; A44B 17/0058; A44B 99/00; A41F 1/004; A41F 1/02; A47G 11/003; Y10T 24/33; A41B 1/10; A41B 2300/324; A41D 27/08
See application file for complete search history.

(56) References Cited

U.S. PATENT DOCUMENTS

| | | | | |
|---|---|---|---|---|
| 3,181,219 | A * | 5/1965 | Deshaies | A44B 17/0058 24/304 |
| 3,947,896 | A * | 4/1976 | Taylor | A41F 17/00 2/217 |
| 4,165,555 | A * | 8/1979 | Boxer | D06F 95/008 24/444 |
| 4,379,538 | A * | 4/1983 | Welles | B65B 67/1227 248/311.2 |
| 6,012,203 | A * | 1/2000 | Baron Pearson | A43B 23/24 24/114.9 |
| 6,185,745 | B1 * | 2/2001 | Alger | A41B 1/06 24/304 |

(Continued)

*Primary Examiner* — Robert Sandy
*Assistant Examiner* — Louis A Mercado
(74) *Attorney, Agent, or Firm* — Daniel S. Polley, P.A.

(57) ABSTRACT

An adhesive fabric fastener for temporary securing two pieces of fabric or an object to a piece of fabric. In one embodiment, the fastener can be a snap assembly which can include ball and socket members each associated with adhesive for temporarily securing the ball and socket members to the fabric/objects. In one non-limiting use the fastener can be used to close or reduce the gap created between buttons on a buttoned shirt and such that the fastener is not seen in use. No modification or alteration to the piece of fabric or garment is required for securing the fastener. In another embodiment the fastener can be a cord secured at one end to adhesive tape and at its other end to another piece of adhesive tape.

5 Claims, 9 Drawing Sheets

(56) References Cited

U.S. PATENT DOCUMENTS

| | | | | |
|---|---|---|---|---|
| 6,216,279 | B1 * | 4/2001 | Ellingson | A45D 8/36 2/239 |
| 7,409,729 | B2 * | 8/2008 | Bahm | A41B 13/005 2/49.1 |
| 7,854,021 | B2 * | 12/2010 | Compton | A41D 27/08 2/243.1 |
| 2010/0005694 | A1 * | 1/2010 | Forte | A47G 1/0616 40/757 |
| 2010/0132595 | A1 * | 6/2010 | Gledhill | A47G 11/003 108/90 |
| 2013/0219667 | A1 * | 8/2013 | Walczak | A45F 5/02 24/3.1 |
| 2016/0324238 | A1 * | 11/2016 | Tran | A41B 1/06 |
| 2017/0035129 | A1 * | 2/2017 | Srivastava | A41B 1/10 |

* cited by examiner

ADHESIVE FABRIC FASTENER

This application is a continuation of U.S. application Ser. No. 15/179,772, filed Jun. 10, 2016, which application claims the benefit of and priority to U.S. Provisional Patent Application Ser. No. 62/173,780, filed Jun. 10, 2015, all applications are incorporated by reference in their entireties for all purposes.

FIELD OF THE DISCLOSURE

The disclosure relates generally to fabric fasteners and particularly to a novel fabric fasteners that can be hidden from view in use and does not require alteration of the fabric for attaching the fastener.

BACKGROUND

There is a need for a fabric fastener that provides a temporary, inexpensive, quick, convenient, removable, flexible and discreet method to fasten two pieces of fabric together or fabric to objects without the need to permanently alter the fabric.

Existing methods to fasten fabric to other fabric or to objects fail to accomplish the above as they: (1) require alteration of the fabric, such as sewing, cutting, which can be laborious, inconvenient and permanent; (2) penetrate the fabric, which may damage the fabric; (3) work only on certain fabrics, such as shirts with hidden panels; (4) require the use of magnets, which may be expensive, present choke hazards for children, and present medical risks to individuals suffering from certain health conditions (see Science "Magnets May Pose Serious Risks For Patients WithPacemakers And ICDs," ScienceDaily, 30 Nov. 2006, and www.sciencedaily.com/releases/2006/11/061130081343.htm and "Gastrointestinal Injuries from Magnet Ingestion in Children" http://www.cdc.gov/mmwr/preview/mmwrhtml/mm5548a3.htm); (5) are rigid and require the fabric to lie flat against the other fabric or object, thereby preventing virtually any space to exist between the two pieces of fabric or fabric and the object.

Additionally, shirts, skirts or dresses that are closed with a row of buttons, snaps, or other fasteners allow the shirt to gap in the areas between the existing fasteners. Garments, including shirts that have been fastened by a row of stationary buttons, snaps and other fabric fasteners, are unable to properly fit all shapes and sizes.

The present disclosure describes a novel fastener overcoming these current shortcomings.

SUMMARY

The present disclosure provides for a novel fabric fastener. The described fastener preferably uses a paper-backed adhesive tape (either self adhesive or heat fusible) with a method to fasten fabric (e.g., a snap, button, string, cord, wire, or other method or mechanism that may be used to fasten fabric). This unique combination for the fastener provides a flexible hold to temporarily and quickly secure fabric to fabric or fabric to objects in a manner that does not require alteration of the fabric and regardless of the type or construction of the fabric.

In one embodiment, the adhesive fabric fastener includes a paper-backed self adhesive or heat fusible tape firmly attached to each part of a two-part snap button or snap assembly. The stud (male member) and corresponding socket (female receiving member) of the snap button or snap assembly are each firmly attached to a piece of self adhesive or heat fusible tape by either an adhesive or a pronged cap. The user firmly attaches one piece of tape (which is firmly attached to either the stud or socket of the snap) to the fabric. The other piece of tape, (which is firmly attached to the corresponding stud or socket of the snap) is firmly attached to the other piece of fabric or object. The user connects the two parts of the snap to securely fasten the fabric to the other fabric or object.

In a modification or alternative embodiment, the fabric fastener can include a string, cord, metal wire or chain, plastic string chain, rope or other similar material (collectively referred to as "cord") to securely fasten two pieces of fabric together or fabric to an object. Each end of the cord is attached to a paper-backed self adhesive or heat fusible tape. Fabric becomes firmly attached to another piece of fabric or other object when the user firmly attaches the tape located at one end of the cord to the fabric and the tape located at the other end of the cord to the other piece of fabric or object.

In another embodiment, the fabric can be attached to another piece of fabric or object by use of a single piece of paper-backed self adhesive tape that is attached to a string, cord, metal wire or chain, plastic string chain, rope or other similar material (collectively referred to as "cord") that is capable of enveloping or encircling the other piece of fabric or other object. The cord is attached to the tape by adhesive, tying, twisting or other method to secure the other piece of fabric or object.

Exemplary applications for embodiments of the disclosed fastener invention include, without limitation:

(1) To secure two pieces of fabric on the same garment, including the following non-limiting examples:

a. To secure the gap that may exists between two preexisting buttons or other fasteners on the panel of a shirt, skirt, or dress. Shirts, skirts or dresses that are closed with a row of stationary buttons, snaps, or other fasteners are unable to properly fit all shapes and sizes. This can allow the shirt to gap in the areas between the existing fasteners;

b. To secure the top of a shirt at a location different from existing prefabricated and stationary/fixed (with respect to the shirt or other garment) buttons. As mentioned above, conventional garments, including shirts that have been fastened by a row of stationary buttons, snaps and other fabric fasteners, are unable to properly fit all shapes and sizes. This can result in limited options for securing the garment in a particular location, including for a person who may want the garment to reveal more or less of their skin. The disclosed adhesive fabric fastener permits the wearer to customize the location that the top of the shirt or dress will be closed when the wearer does not want to close the shirt or dress at the location of any preexisting button;

c. To secure the bottom of a shirt tucked into pants to the pants to prevent shirt tails from spreading apart or the shirt from becoming untucked and coming out of the pants;

d. To secure a shirt collar to the shirt without the need of magnets or alterations;

e. To temporarily tighten the waist of a shirt by folding the fabric of the shirt, which thereby slenders the fit of the shirt and prevents the shirt from appearing baggy; and f. To act as a temporary replacement for a missing prefabricated button on a garment;

(2) To secure two articles of clothing together, including the following non-limiting examples:

a. To secure a bra strap to a garment to prevent the bra strap from falling off the shoulder or from peeking out behind the shoulder straps of the garment;

b. To secure a strapless bra to a garment to prevent the strapless bra from slipping;

c. To secure shirt tails and the back of a shirt to a pair of pants to prevent the shirt from bulding or becoming partly or fully untucked; and d. To secure a shawl or wrap to a shirt or other garment.

(3) To secure fabric to objects, including the following non-limiting examples:

a. To attach a name tag to a garment without the need for pins that may damage the fabric and without the need for magnets that may be contraindicated for individuals with certain health conditions;

b. To secure any decorative object to a garment, including objects traditionally fastened by a pin;

c. To secure a tablecloth to a table, to prevent the tablecloth from slipping off the table or flying away; and d. To secure a table skirt, banner or other ornamentation to a tablecloth.

Thus, the described novel adhesive fabric fastener provides for a quick, temporary, inexpensive and discreet method to secure two pieces of fabric together and to secure objects to fabric without the need for: (1) sewing or cutting, which can be laborious, inconvenient and permanent; (2) the use of pins or other objects that penetrate and may damage the fabric; or (3) the use of magnets that can be expensive, contraindicated for individuals suffering from certain health conditions.

The securement of the fastener to the fabric(s) and/or object(s) can be of a removable nature or a permanent nature.

Other systems, methods, features and advantages of the disclosure will be, or will become, apparent to one of ordinary skill in the art upon examination of the following figures and the entire description. It is intended that all such additional systems, methods, features and advantages be included within this description and this summary, be within the scope of the disclosure.

DETAILED DESCRIPTION

Figure 1:
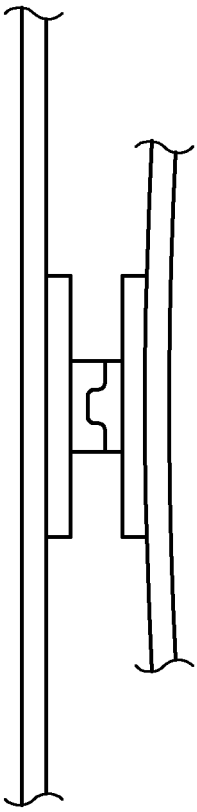
FIG. 1 is a side view of a first embodiment for the novel fabric fastener of the current disclosure shown attached to two pieces of fabric

The various embodiments can be better understood with reference to the following drawings and description. The components in the figures are not necessarily to scale, emphasis instead being placed upon illustrating the principles of the embodiment. Moreover, in the figures, like reference numerals, if provided, designate corresponding parts throughout the different views.

FIG. 1 illustrates a first embodiment for the fabric fastener shown attached to two pieces of fabric, with only portions of the fabrics shown. The paper-backed self adhesive or heat fusible tape attaches to the garment. Firmly attached to the tape by either pronged cap or adhesive is a snap stud or corresponding snap socket. It is to be understood that various adhesive materials and/or processes may be employed to attach the snap button to the adhesive tape. The combination of the snap stud with the snap socket is used to secure two pieces of fabric together or an object to fabric.

Figure 2:
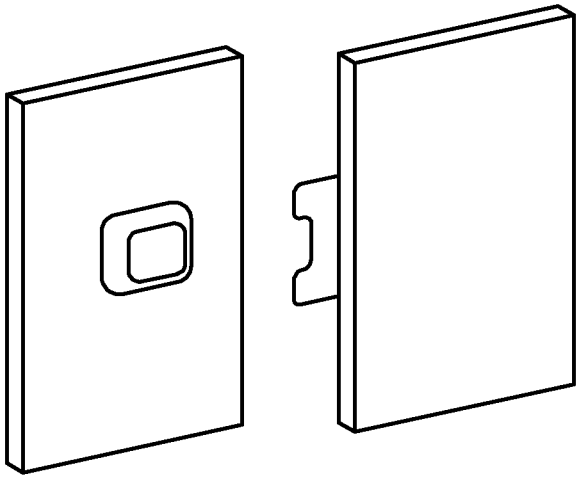
FIG. 2 is an exploded perspective view of the fabric fastener of FIG. 1.

FIG. 2 illustrates the fabric fastener as described in FIG. 1 depicting the components of the snap button attached to the adhesive tape by an adhesive.

Figure 3:
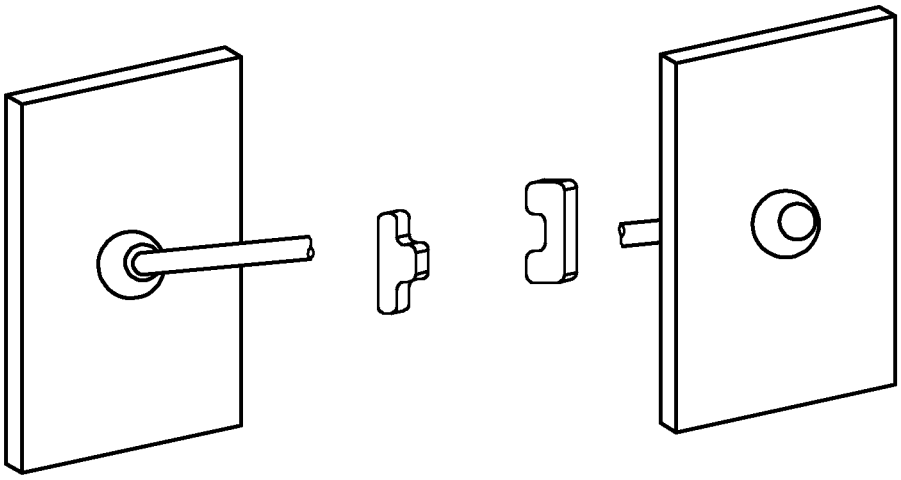
FIG. 3 is an exploded perspective view of the fabric fastener of FIG. 1.

FIG. 3 illustrates the fabric fastener as described in FIG. 1 depicting the components of snap button attached to the adhesive tape by a pronged cap.

Figure 4A:
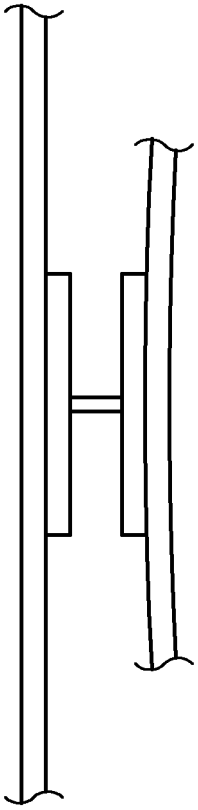
FIG. 4A is a side view of an alternative embodiment for the fabric fastener in accordance with the disclosure.
Figure 4B:
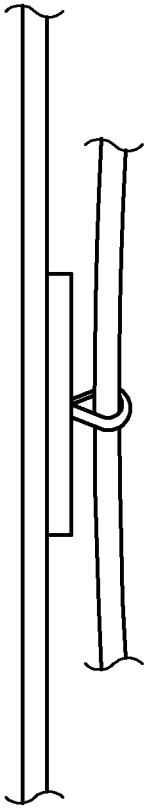
FIG. 4B is a side view of another alternative embodiment for the fabric fastener in accordance with the disclosure.

FIG. 4 illustrates an alternative embodiment for the fabric fastener shown attached to fabric, with only portions of the fabric(s) shown. In FIG. v.1 the fabric fastener uses a string, cord, metal chain, plastic chain, rope or other similar material ((collectively referred to as "cord") that is firmly attached at each end to a paper-backed self adhesive or heat fusible fabric tape to secure two pieces of fabric together or fabric to an object. In FIG. v.2 a single piece of paper-backed self adhesive tape that is attached to a string, cord, metal wire or chain, plastic chain, or other similar material (collectively referred to as "cord") is used that is capable of enveloping or encircling the other piece of fabric or other object. The cord is attached to the tape by adhesive, tying or other twisting.

In another modification or embodiment, the fabric can be attached to another piece of fabric or other object by use of a single piece of paper-backed self adhesive tape that is attached to a string, cord, metal wire or chain, plastic chain, rope or other similar material (collectively referred to as "cord") that is capable of enveloping or encircling the other piece of fabric or other object. The cord is attached to the tape by adhesive, tying or other twisting.

Figure 5:
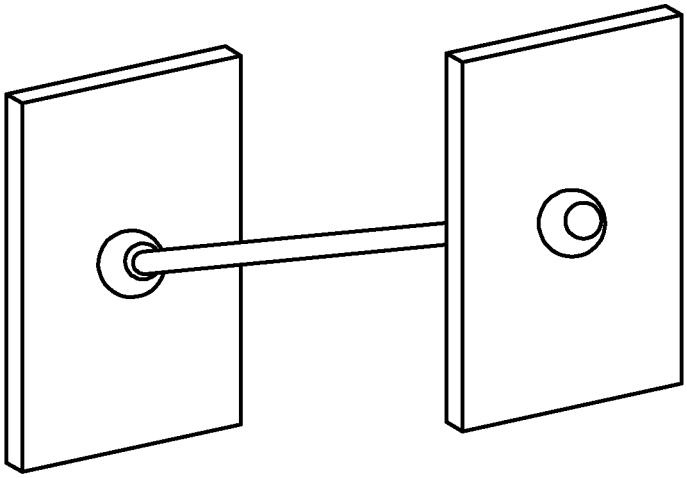
FIG. 5 is a perspective view of the fabric fastener as described in FIG. 4A.

FIG. 5 illustrates the fabric fastener as described in FIG. 4 depicting the string, cord, metal chain, plastic chain, rope or other link firmly attached at each end to a paper-backed self adhesive or heat fusible fabric tape.

Figure 6:
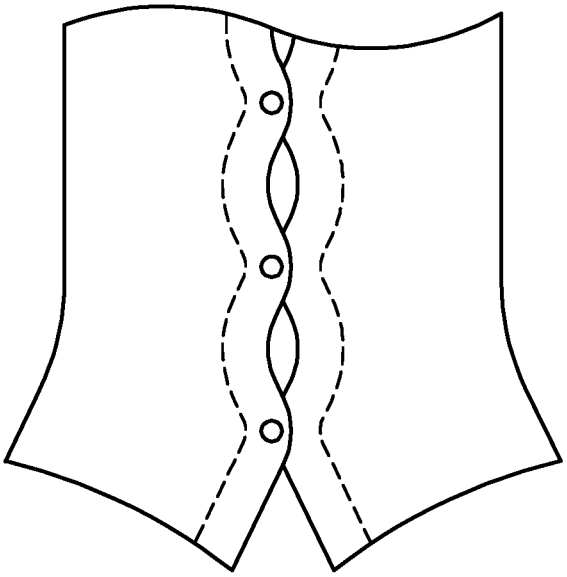
FIG. 6 is a front/perspective view of a portion of a typical garment with gaping present.

FIG. 6 illustrates a typical garment with gaping present between prefabricated buttons and gaping existing after the last button.

Figure 7A:
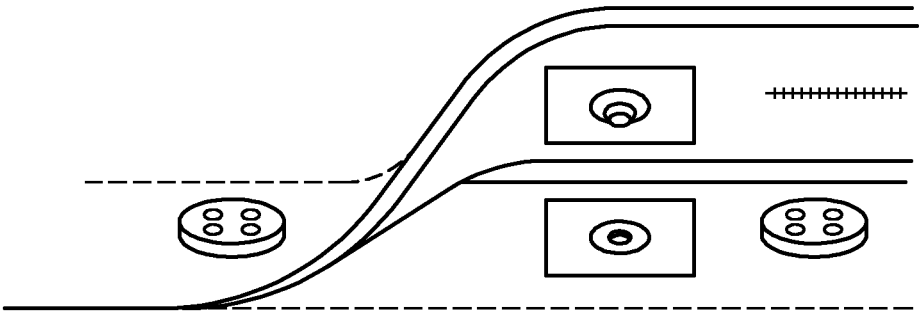
FIG. 7A is a perspective view showing the fabric fastener of FIG. 1.
Figure 7B:
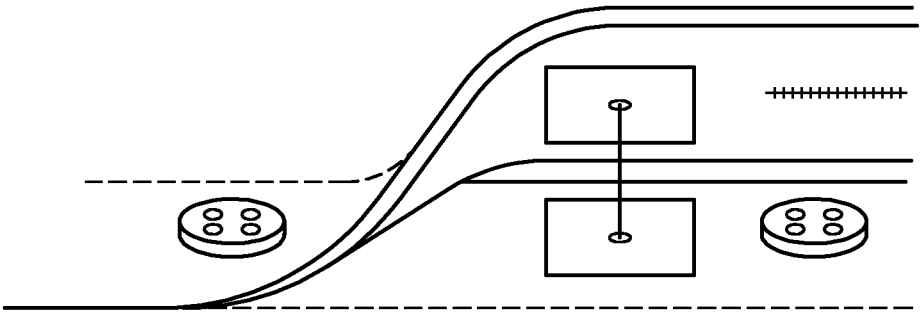
FIG. 7B is a perspective view showing the fabric fastener of FIG. 4A.

FIG. 7 illustrates the fabric fastener described in FIG. 1 (top) and FIG. 4 (bottom) depicting the placement of the adhesive fabric fastener between two existing buttons on a garment thereby securing a first panel to a second panel of a garment's button panel (e.g., the buttons of a shirt, skirt or dress) in a manner that is not visible from a front view of the garment, particularly when the garment is worn by the wearer.

Figure 8:
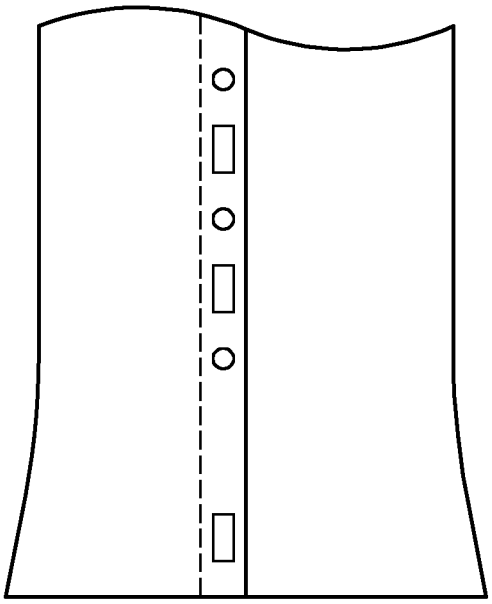
FIG. 8 is a front/perspective view of the garment of FIG. 6 with the disclosed fabric fastener placed between two preexisting buttons to prevent gaping between the buttons and at the bottom of the garment after the last preexisting button to prevent the bottom of the shirt from spreading or gaping apart (the fasteners are represented by rectangles for illustrations purposes and in use would not be seen from the front of the garment).

FIG. 8 illustrates the garment, as described in FIG. 6, after one of the disclosed adhesive fabric fasteners is placed between two preexisting buttons to prevent gaping between the buttons and at the bottom of the garment after the last preexisting button to prevent the bottom of the shirt from spreading or gaping apart.

Figure 9:
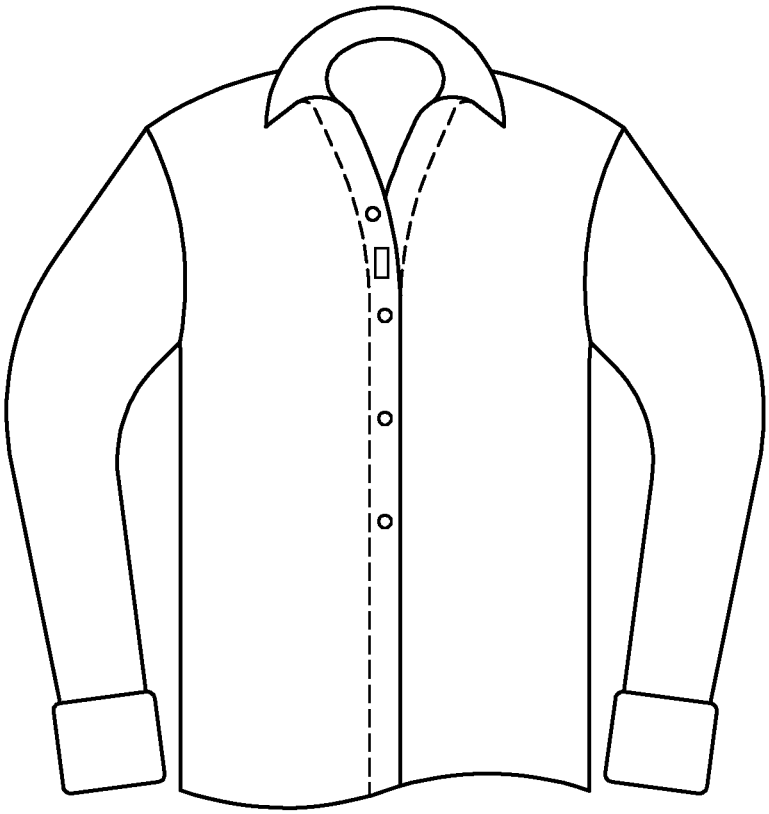
FIG. 9 is a view of a shirt worn open at a location different from the preexisting button through use of one of the novel disclosed fabric fasteners (the fastener is represented by a rectangle for illustration purposes and in use would not be seen from the front of the shirt)

FIG. 9 illustrates a shirt worn open at a location different from the preexisting button through use of one of the above described fabric fastener embodiments to permit the wearer to customize the location that the top of the shirt will be closed when the wearer does not want to close the shirt at the location of either preexisting button.

Figure 10:
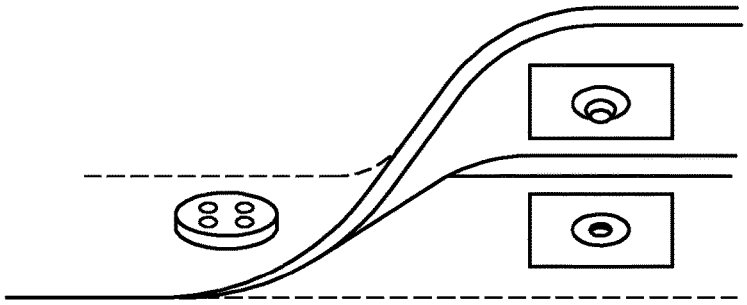
FIG. 10 is a perspective view of a button panel where the disclosed adhesive fabric fastener is placed where a preexisting button is missing.

FIG. 10 illustrates a button panel where one of the disclosed adhesive fabric fasteners is placed where a preexisting button is missing.

Figure 11:
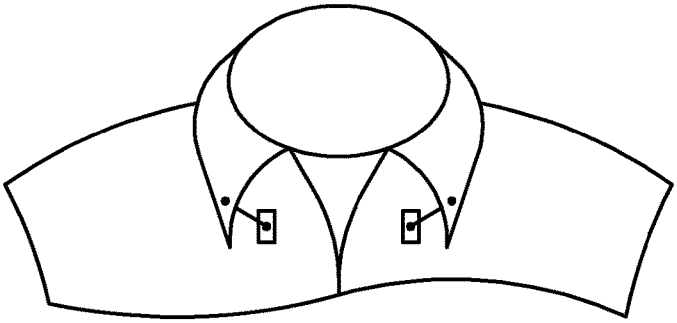
FIG. 11 is a perspective view of a shirt where the disclosed adhesive fabric fastener is securing a collar to a shirt.

FIG. 11 illustrates a shirt where one of the disclosed adhesive fabric fasteners is securing a collar to a shirt.

Figure 12:
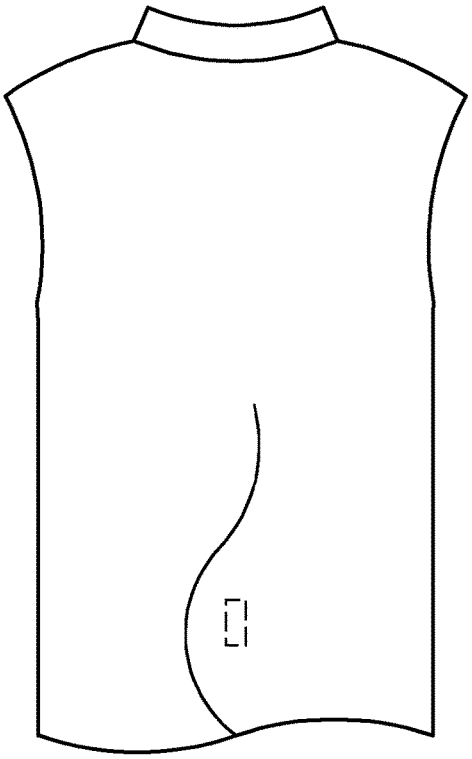
FIG. 12 is a front view of the disclosed adhesive fabric fastener securing excess fabric of a shirt (the fastener is represented by a dashed rectangle for illustration purposes and in use would not be seen from the back of the shirt.

FIG. 12 illustrates one of the disclosed adhesive fabric fasteners securing excess fabric of a shirt to temporarily tighten the garment thereby avoiding a baggy appearance.

Figure 13:
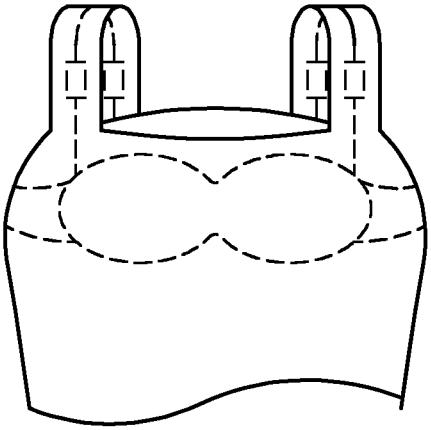
FIG. 13 is a front view of the disclosed adhesive fabric fastener securing a bra strap to a garment (the fasteners are represented by a dashed rectangle for illustration purposes and in use would not be seen from the front or back of the garment.

FIG. 13 illustrates one of the disclosed adhesive fabric fasteners securing a bra strap to a garment.

Figure 14:
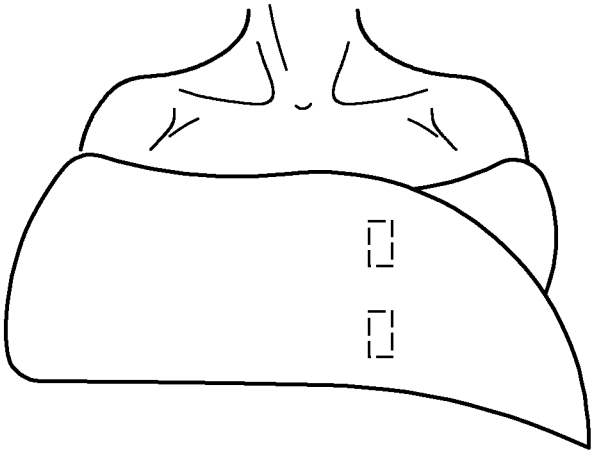
FIG. 14 is a front view of the disclosed adhesive fabric fastener securing the ends of a shawl or wrap around an individual (the fasteners are represented by a dashed rectangle/square for illustration purposes and in use would not be seen from the front of the shawl)

FIG. 14 illustrates one of the disclosed adhesive fabric fasteners securing the ends of a shawl or wrap around an individual.

Figure 15:
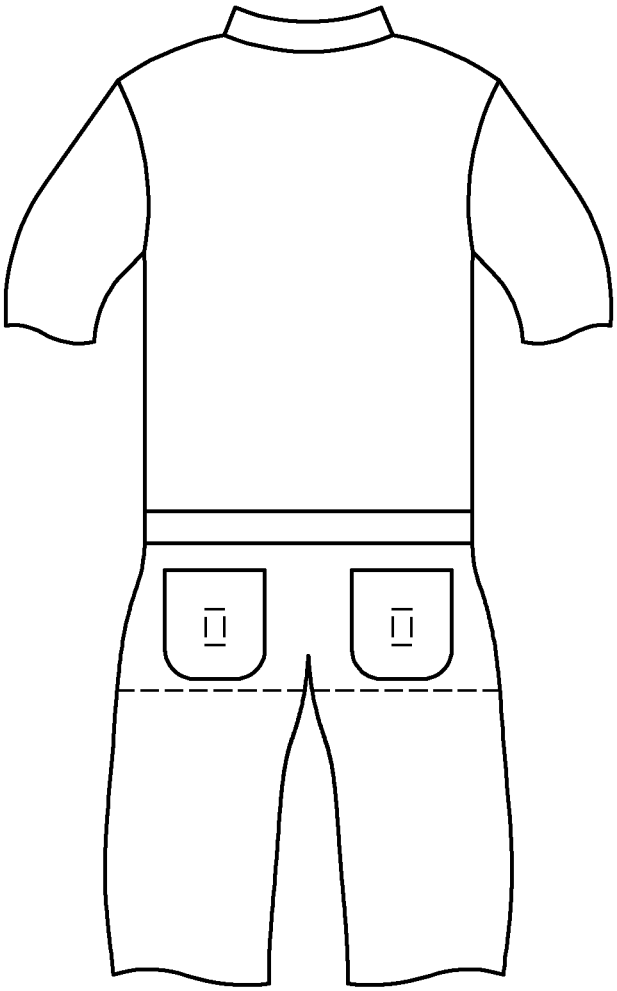
FIG. 15 is a front view of the disclosed adhesive fabric fastener securing a shirt in place inside pants, including the shirt tails and the back of a shirt into a pair of pants (the fasteners are represented by a dashed rectangle for illustration purposes and in use would not be seen from the back of the pants)

FIG. 15 illustrates one of the disclosed adhesive fabric fasteners securing a shirt in place inside pants, including the shirt tails and the back of a shirt into a pair of pants.

Figure 16:
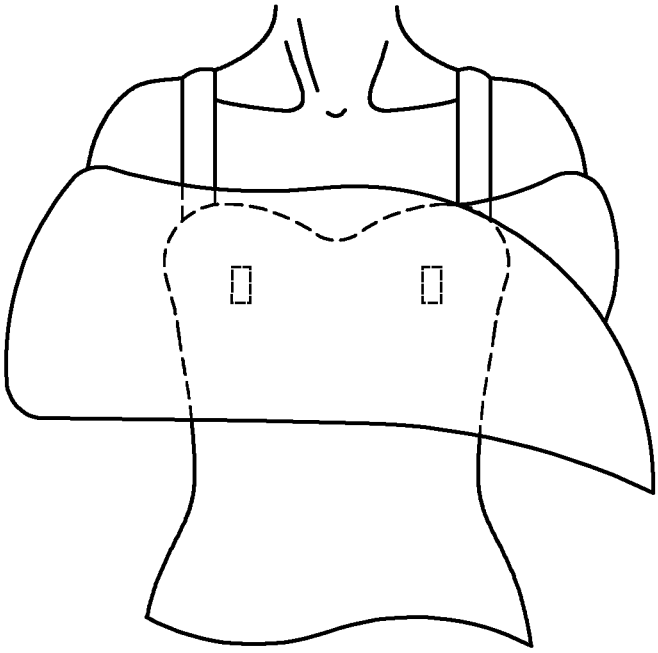
FIG. 16 is a front view of the disclosed adhesive fabric fastener securing a shawl or wrap or other fabric to a dress or shirt (the fasteners are represented by a dashed rectangle/square for illustration purposes and in use would not be seen from the front of the shawl)

FIG. 16 illustrates one of the disclosed adhesive fabric fasteners securing a shawl or wrap or other fabric to a dress or shirt.

Figure 17:
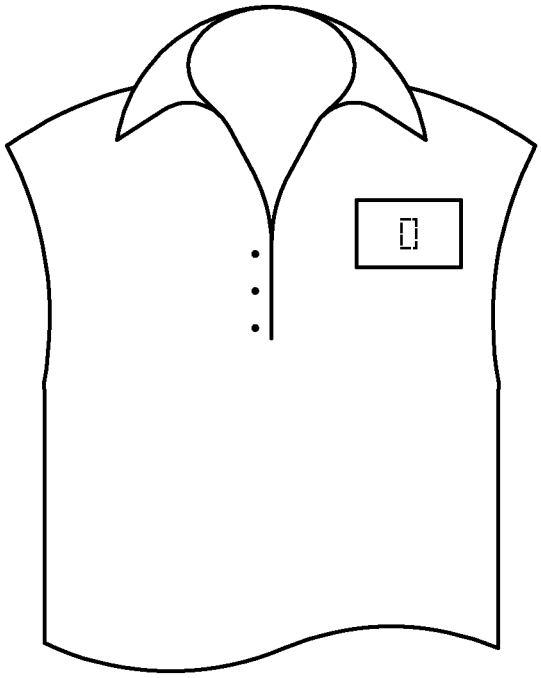
FIG. 17 is a front view of the disclosed adhesive fabric fastener securing a badge or name tag to a garment without the needs for pins that may damage fabric (the fasteners are represented by a dashed rectangle/square for illustration purposes and in use would not be seen from the front of the shirt/badge)

FIG. 17. Illustrates one of the disclosed adhesive fabric fasteners securing a badge or name tag to a garment without the needs for pins that may damage fabric.

Figure 18:
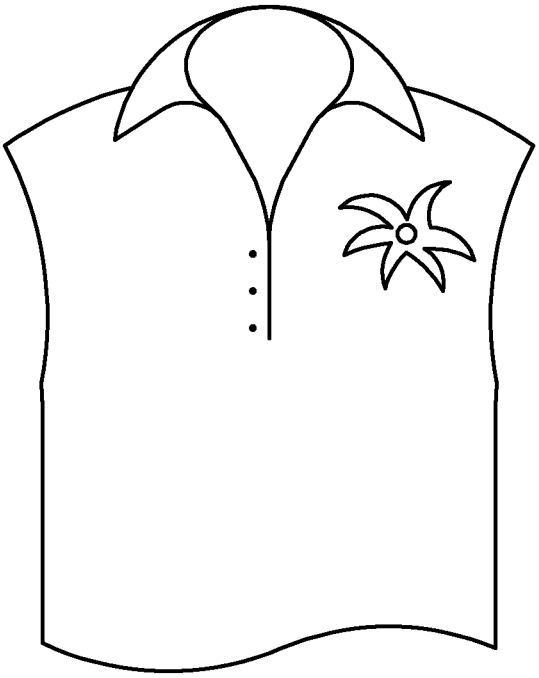
FIG. 18 is a front view of the adhesive fabric fastener securing any decorative object to a garment, including objects traditionally fastened by a pin with the fastener hidden behind the decorative object.

FIG. 18 illustrates one of the disclosed adhesive fabric fasteners securing any decorative object to a garment, including objects traditionally fastened by a pin.

Figure 19:
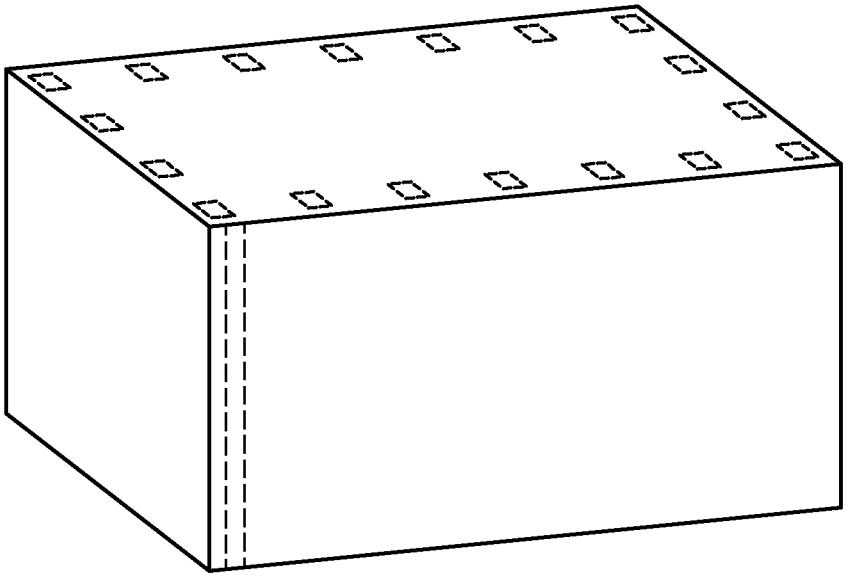
FIG. 19 is a perspective view of the disclosed adhesive fabric fasteners securing a tablecloth to a table to prevent slipping or fly-away (the fasteners are represented by a dashed rectangle/square for illustration purposes and in use would not be seen)

FIG. 19 illustrates a plurality of one or more of the disclosed adhesive fabric fasteners securing a tablecloth to a table to prevent slipping or fly-away (i.e. picnic table, etc.).

Figure 20:
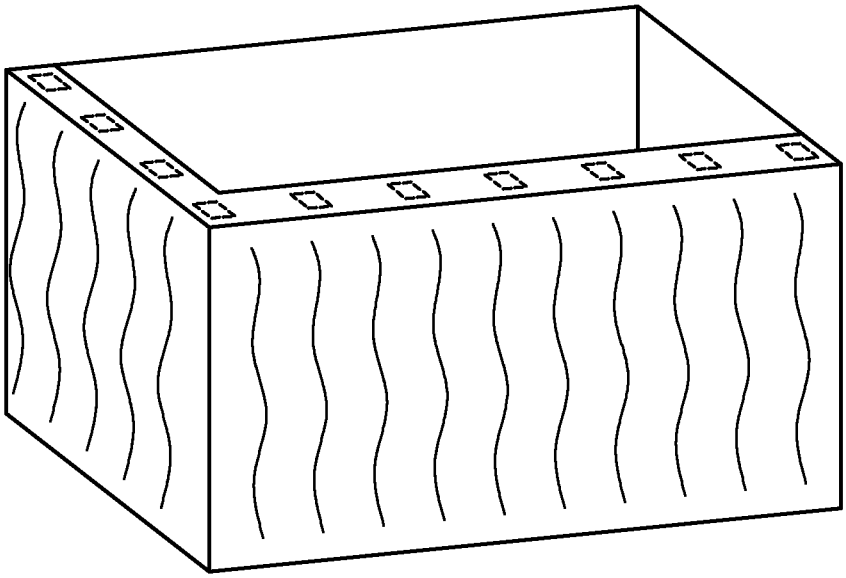
FIG. 20 is a perspective view of the disclosed adhesive fabric fastener securing a table skirt to a covered table (the fasteners are represented by dashed or undashed rectangle/squares for illustration purposes and in use would not be seen)

FIG. 20 illustrates a plurality of one or more of the disclosed adhesive fabric fasteners securing a table skirt to a covered table.

Figure 21A:
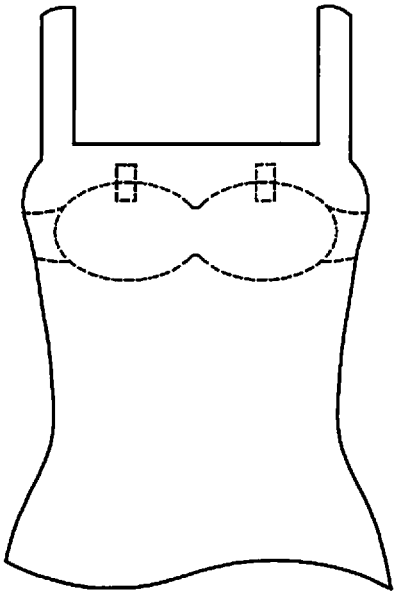
FIG. 21A, FIG. 21B and FIG. 21C are front views of the disclosed adhesive fabric fastener showing several versions of strapless bras being fastened to a garment (the fasteners are represented by a rectangles for illustration purposes and in use would not be seen from the front of the garment).
Figure 21B:
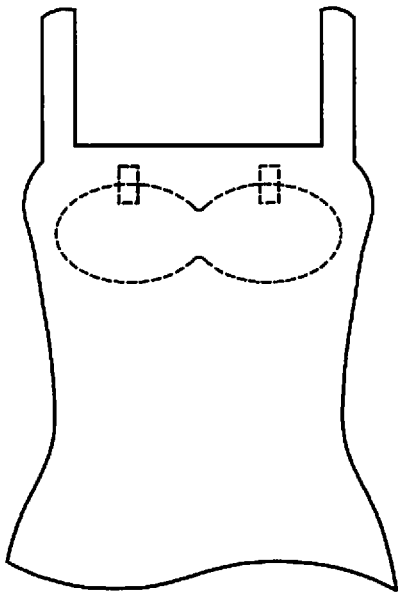
Figure 21C:
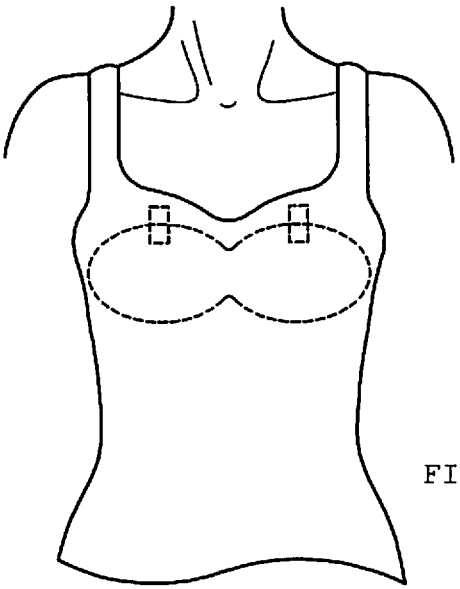

FIG. 21 illustrates one of the disclosed adhesive fabric fasteners securing several versions of a strapless bra to a garment.

Certain advantages and applications for the above described novel fabric fastener include, without limitation:

1. An adhesive fabric fastener comprising: a two-part snap button, comprising of stud and corresponding socket, comprised of metal, plastic, wood or other material that are each firmly attached to a piece of paper-backed self-adhesive or heat fusible tape (hereinafter "tape"). The components of the snap button are attached to the tape by either an adhesive or pronged cap. The piece of tape may be of varying widths and lengths. The user attaches one piece of tape, which is attached to either the stud or socket, to fabric. The user attaches the other piece of tape, which is attached to the corresponding stud or socket, to the other fabric or object. When snapped together, the adhesive fabric fastener provides a temporary, flexible, discreet and removable method for securing two pieces of fabric together or fabric to an object.

In another aspect or embodiment, the adhesive fabric fastener comprises a string, cord, metal chain, plastic string or chain, rope or other similar material (collectively referred to as "cord") firmly attached at each end to a piece of paper-backed self-adhesive or heat fusible tape. The piece of tape may be of varying widths and lengths to secure two pieces of fabric together or a fabric to an object.

The user attaches one piece of tape, which is attached to one end of the cord, to the fabric. The fabric is attached to the other fabric or object when the user attaches the other piece of tape, which is attached to the other end of the cord, to the other fabric or object. The adhesive fabric fastener provides a temporary, flexible, discreet and removable method for securing two pieces of fabric together or fabric to an object.

In another aspect or embodiment, the fabric is attached to another piece of fabric or other object by use of a single piece of paper-backed self-adhesive tape that is attached to a string, cord, metal wire or chain, plastic string or chain, rope or other similar material (collectively referred to as "cord") that is capable of enveloping or encircling the other piece of fabric or other object to secure the fabric to the other fabric or object. The cord is attached to the tape by adhesive, tying, twisting or other method to secure the other fabric or object.

2. A fabric fastener as described in 1 securing a first panel to a second panel of a garment's button panel (e.g., the buttons of a shirt, skirt or dress), including between two preexisting buttons, snaps or other closure devices or below the lowest preexisting button, snaps, or other closure devices in a manner that is not visible from a front view of the garment.

3. A fabric fastener as described in 1 and 2 placed between two preexisting buttons, snaps, or other closure devices to prevent the shirt from gaping open between the two prefabricated buttons.

4. A fabric fastener as described in 1 and 2 placed between two preexisting buttons, snaps, or other closure device to permit the wearer to customize the location that the top of the shirt will be closed when the wearer does not want to close the shirt at the location of either preexisting button.

5. A fabric fastener as described in 1 and 2 placed below the lowest prefabricated button, snaps or other closure device to prevent the bottom of the shirt from spreading or gaping apart.

6. A fabric fastener as described in 1 and 2 placed where a pre-existing button, snap or other closure device is missing to provide a temporary solution when a button is lost or damaged.

7. A fabric fastener as described in 1 securing a collar to a shirt.

8. A fabric fastener as described in 1 securing excess fabric of a shirt to temporarily tighten the garment thereby avoiding a baggy appearance.

9. A fabric fastener as described in 1 securing a bra strap to a garment.

10. A fabric fastener as described in 1 securing a shawl, wrap or other garment around an individual.

11. A fabric fastener as described in 1 that is removable attached for securing one garment to another garment in a temporary manner and that is not visible from a front view of the top garment.

12. A fabric fastener as described in 1 securing a strapless bra to a garment.

13. A fabric fastener as described in 1 securing a shirt that is tucked inside of pants to the pants, including the shirt tails and the back of the shirt to the pants.

14. A fabric fastener as described in 1 securing a shawl, wrap or other fabric to a dress or shirt.

15. A fabric fastener as described in 1 securing the fabric to an object in manner that is not visible from a front view of the object.

16. A fabric fastener as described in 1 securing a badge or name tag to a garment without the need for pins that may damage fabric or magnets that may pose a health risk to certain individuals.

17. A fabric fastener as described in 1 securing any decorative object to a garment, including objects traditionally fastened by a pin.

18. A fabric fastener as described in 1 securing a tablecloth to a table to prevent slipping or fly-away.

19. A fabric fastener as described in 1 securing a table skirt, banner or other decorative item to a covered table.

It should be understood that the exemplary embodiments described herein should be considered in a descriptive sense only and not for purposes of limitation. Descriptions of features or aspects within each embodiment should typically be considered as available for other similar features or aspects in other embodiments. While one or more embodiments have been described with reference to the figures, it will be understood by those of ordinary skill in the art that various changes in form and details may be made therein without departing from their spirit and scope.

All components and parts of the described adhesive fabric fastener and their locations, attachment or securement mechanisms, fastening mechanisms, dimensions, values, materials, shapes, etc. discussed above or shown in the drawings, if any, are merely by way of example and are not considered limiting and other component(s) and their locations, attachment or securement mechanisms, fastening mechanisms, dimensions, values, materials, shapes, etc. can be chosen and used and all are considered within the scope of the disclosure.

Additionally, the disclosure is not considered limited to the fabrics, garments or objects discussed above and/or shown in the drawings and use of one or more of the disclosed adhesive fabric fasteners with other fabrics, garments or objects is also considered within the scope of the disclosure.

Unless feature(s), part(s), component(s), characteristic(s) or function(s) described in the specification or shown in the drawings for a claim element, claim step or claim term specifically appear in the claim with the claim element, claim step or claim term, then the inventor does not consider such feature(s), part(s), component(s), characteristic(s) or function(s) to be included for the claim element, claim step or claim term in the claim when and if the claim element, claim step or claim term is interpreted or construed. Similarly, with respect to any "means for" elements in the claims, the inventor considers such language to require only the minimal amount of features, components, steps, or parts from the specification to achieve the function of the "means for" language and not all of the features, components, steps or parts describe in the specification that are related to the function of the "means for" language.

The benefits, advantages, solutions to problems, and any element(s) that may cause any benefit, advantage, or solution to occur or become more pronounced are not to be construed as a critical, required, or essential features or elements of any or all the claims.

While the adhesive fabric fastener has been described and disclosed in certain terms and has disclosed certain embodiments or modifications, persons skilled in the art who have acquainted themselves with the disclosure, will appreciate that it is not necessarily limited by such terms, nor to the specific embodiments and modification disclosed herein. Thus, a wide variety of alternatives, suggested by the teachings herein, can be practiced without departing from the spirit of the disclosure, and rights to such alternatives are particularly reserved and considered within the scope of the disclosure.

What is claimed is:

1. An adhesive secured temporary fabric fastener, comprising:

a first portion of a fastening member, the first portion having a first back surface, said first portion adapted for securement to a piece of fabric;

a second portion of the fastening member, the second portion having a second back surface, said second portion adapted for securement to a piece of fabric or an object;

a first piece of paper-backed self-adhesive or heat fusible tape provided at the first back surface; and a second piece of paper-backed self-adhesive or heat fusible tape provide at the second back surface;

wherein in use the first portion is non-permanently secured to the piece of fabric by the first self-adhesive or the heat fusible tape and the second portion is non-permanently secured to the piece of fabric or the object by the second self-adhesive or the heat fusible tape and the piece of fabric is secured to the piece of fabric or the object by securing the first portion to the second portion;

wherein securement of the fastening member to the piece of fabric or the object is achieved without any alterations or piercing of the fabric or the object;

wherein the piece of fabric is a button down shirt having a plurality of buttons and a corresponding number of button holes with the buttons spaced apart along a portion of a first side of the shirt and the button holes spaced apart along a portion of a second side of the shirt, wherein when the shirt is buttoned the portion of the second side of the shirt overlaps a portion of the first side of the shirt such that the buttons and the corresponding button holes are aligned with each other, wherein in buttoned configuration for the shirt the first portion of the fastening member is non-permanently secured to the portion of the first side of the shirt between two adjacent buttons and the second portion of the fastening member is non-permanently secured to an internal area of the second side of the shirt between two the corresponding adjacent button holes such that the fastening member is hidden from view in use and helps to reduce or eliminate any gap created between the adjacent buttons and corresponding the button holes.

2. The adhesive secured temporary fabric fastener of claim 1 wherein the fastening member is a two-part snap button with the first portion comprising a stud member and the second portion comprising a socket member for receipt of the stud member in use.

3. The adhesive secured temporary fabric fastener of claim 1 wherein the first portion is a first end of a cord and the second portion is a second end of the cord.

4. The adhesive secured temporary fabric fastener of claim 2 wherein the stud member is secured to the first self-adhesive or the heat fusible tape by a first prong member and the socket member is secured to the second self-adhesive or the heat fusible tape by a second prong member.

5. The adhesive secured temporary fabric fastener of claim 1 wherein the fastening member is hidden from view during use.

* * * * *